US006993271B2

(12) United States Patent
Sakabe

(10) Patent No.: US 6,993,271 B2
(45) Date of Patent: Jan. 31, 2006

(54) IMAGE PROCESSING APPARATUS

(75) Inventor: Tomokazu Sakabe, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/935,170

(22) Filed: Sep. 8, 2004

(65) Prior Publication Data

US 2005/0031378 A1 Feb. 10, 2005

Related U.S. Application Data

(63) Continuation of application No. 10/391,551, filed on Mar. 20, 2003.

(51) Int. Cl.
*G03G 15/36* (2006.01)

(52) U.S. Cl. ..... 399/182; 399/183

(58) Field of Classification Search ..... 382/309, 382/310, 311; 399/81, 182, 183, 184, 185
See application file for complete search history.

(56) References Cited

U.S. PATENT DOCUMENTS 5,671,429 A * 9/1997 Tanaka ..... 715/530

FOREIGN PATENT DOCUMENTS

JP 11-187279 A 7/1999

* cited by examiner

*Primary Examiner*—Hoang Ngo
(74) *Attorney, Agent, or Firm*—Foley & Lardner LLP

(57) ABSTRACT

A patch image applied to a processing region to be subjected to a trimming/masking process is formed based on a background image of an original image or the like and an image of the processing region in the original image is replaced by the patch image.

14 Claims, 7 Drawing Sheets

IMAGE PROCESSING APPARATUS

The present application is a Continuation of U.S. application Ser. No. 10/391,551, filed Mar. 20, 2003, the entire contents of which is incorporated herein by reference.

BACKGROUND OF THE INVENTION

This invention relates to an image processing apparatus and image processing method which perform a trimming process or masking process with respect to an input image (original image), for example, and an image forming apparatus which forms an image subjected to the trimming process or masking process on an image forming medium.

In a conventional image processing apparatus, when the trimming process or masking process is performed, a region specified by the user is set as a region to be processed and the trimming process or masking process is performed with respect to the thus set region. In the conventional image processing apparatus, the entire portion of the image of the region subjected to the trimming process or masking process is replaced by fixed image data.

That is, in the trimming process or masking process in a conventional image processing apparatus, image data of the region to be processed is converted into white data (blank data) or fixed data, for example. Therefore, in the conventional image processing apparatus, there occurs a problem that the color of the region subjected to the trimming process or masking process becomes an unnatural color which is different from the background color.

BRIEF SUMMARY OF THE INVENTION

An object of this invention is to provide an image processing apparatus, image forming apparatus and image processing method which can convert an image of a processing region to be subjected to the trimming process or masking process to an image which the user wishes to obtain.

An image processing apparatus according to an aspect of the invention which performs an image modifying process with respect to an original image input via an image input section, for example, comprises a processing region setting section which sets a processing region in the original image input via the image input section, an image forming section which forms a patch image to be applied to the processing region specified by the processing region specifying section based on the original image input via the image input section, and an image editing section which replaces the image of the processing region in the original image input via the image input section by the patch image formed by the image forming section.

An image processing method according to another aspect of the invention which processes an original image input via an image input section, for example, comprises setting a processing region in the original image, forming a patch image to be applied to a processing region based on the original image input via the image input section, and replacing the image of the processing region in the original image input via the image input section by the patch image.

An image forming apparatus according to still another aspect of the invention which includes a scanner to read an image of a document, comprises a processing region setting section which sets a processing region in the image of the document read by the scanner, an image forming section which forms a patch image to be applied to the processing region specified by the processing region specifying section based on the image of the document read by the scanner, an image editing section which replaces the image of the processing region in the image of the document read by the scanner by the patch image formed by the image forming section, and a printer which prints an image obtained by replacing the image of the processing region by the patch image by use of the image editing section on an image forming medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate an embodiment of the invention, and together with the general description given above and the detailed description of the embodiment given below, serve to explain the principles of the invention.

DETAILED DESCRIPTION OF THE INVENTION

There will now be described an embodiment of this invention with reference to the accompanying drawings.

Figure 1:
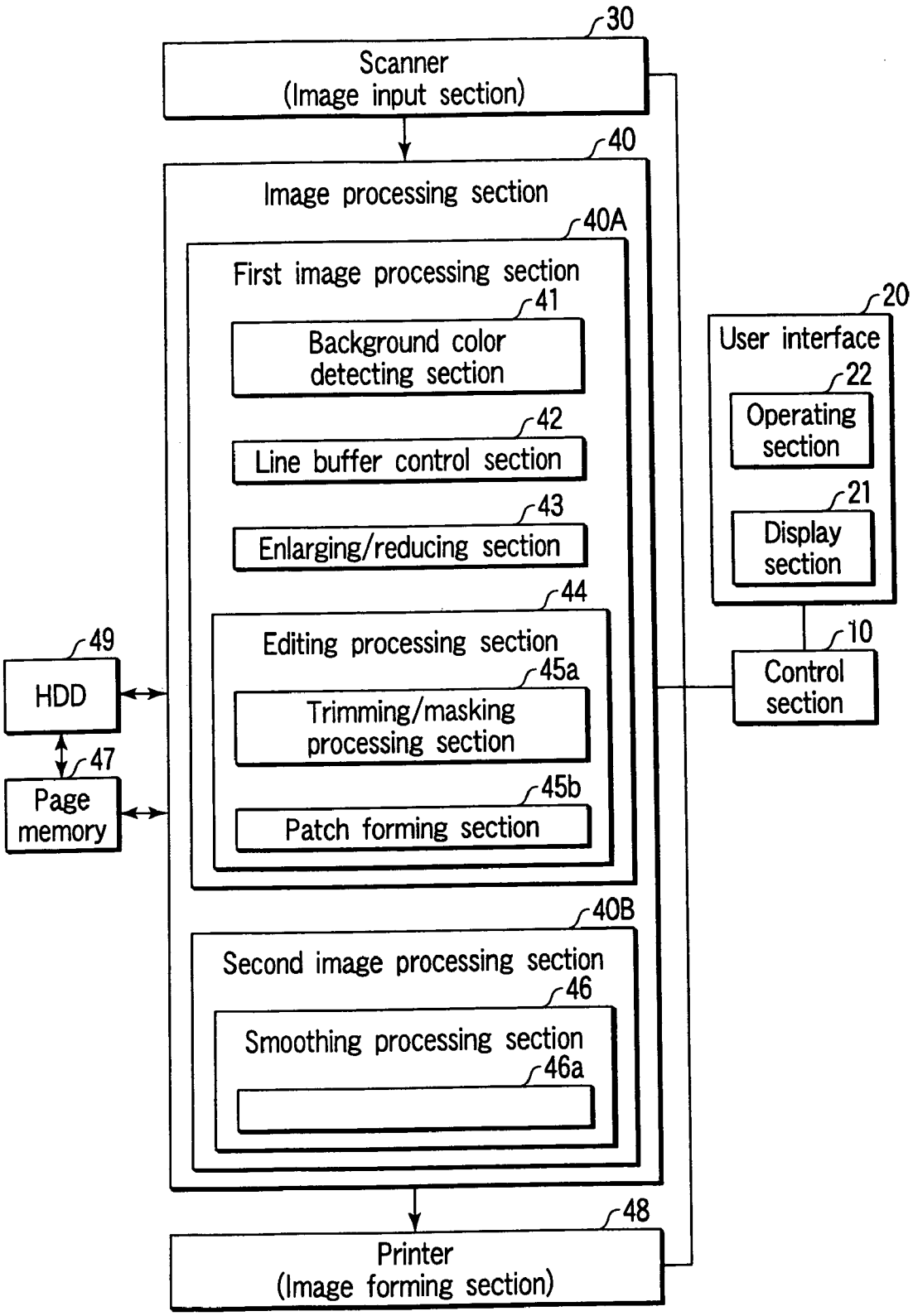
FIG. 1 is a block diagram showing the internal configuration of an image forming apparatus.

FIG. 1 is a block diagram showing the schematic configuration of an image forming apparatus according to the embodiment of this invention.

As shown in FIG. 1, the image forming apparatus includes a control section 10, user interface 20, image input section 30 such as a scanner, image processing section 40, page memory 47, printer 48 and HDD 49.

The control section 10 has a CPU (central processing unit), a memory in which a control program and control data are stored, and various interfaces. The control section 10 controls the whole portion of the image forming apparatus. The control section 10 is connected to the user interface 20, scanner 30, image processing section 40, page memory 47, printer 48 and the like.

The user interface 20 includes a display section 21 and operating section 22. For example, the user interface 20 is configured by a liquid crystal display device containing hard keys and touch panel. The display section 21 of the user interface 20 displays guidance for the user, for example. The operating section 22 of the user interface 20 is used to input an instruction from the user by use of the hard keys and touch panel.

The scanner used as the image input section 30 optically reads a document and inputs an image of the document. Further, the image input section 30 may be used to input an original image from the external device. The image input section 30 is operated in response to an operation instruction from the control section 10. In addition, the image input section 30 supplies an input image (original image) to the image processing section 40. The image input section 30 can use a device which inputs image data from the external device via a network instead of the scanner.

The image processing section 40 subjects image data supplied from the image input section 30 to an image modifying process. As shown in FIG. 1, the image processing section 40 has a plurality of processing sections. The image processing section 40 selectively performs the process by one of the processing sections with respect to the image data based on the operation instruction from the control section 10. Image data processed by the image processing section 40 is stored in the page memory 47. Further, the image processing section 40 is connected to the HDD 49 used as a memory device to store an image input from the image input section 30. The image processing section 40 can store an image in the HDD 49 and read an image stored in the HDD 49.

If image data processed by the image processing section 40 is stored in the page memory 47, the printer 48 performs the image forming process for forming an image on an image forming medium based on image data stored in the page memory 47. The printer 48 includes a feeding mechanism which feeds an image forming medium, a developing device which forms an image on an image carrier, a transfer device which transfers the image formed on the image carrier onto the image forming medium, and a fixing device which fixes the image transferred to the image forming medium.

Next, an example of the configuration of the image processing section 40 is explained.

As shown in FIG. 1, the image processing section 40 has a first image processing section 40A and second image processing section 40B. The first image processing section 40A is used to perform the trimming process or masking process with respect to an image input by the image input section 30. The second image processing section 40B is used to perform the smoothing process with respect to the image processed by the first image processing section 40A.

The first image processing section 40A includes a background color detecting section 41, line buffer control section 42, enlarging/reducing section 43 and editing processing section 44. The editing processing section 44 includes a trimming/masking processing section 45.

The background color detecting section 41 performs a process for detecting the background color as a background image in the image. The line buffer control section 42 performs a buffer control process for lines of the image. The enlarging/reducing section 43 performs the enlargement/reduction process with respect to the image. The editing processing section 44 performs the editing process such as image composition, color conversion and the like with respect to the image. The trimming/masking processing section 45 performs the trimming process or masking process among various functions which the editing processing section 44 has.

Further, the background color detecting section 41 performs a process for detecting the background color as a background image in a specified region of an input image (original image). In this case, as the specified region of the input image, a preset region or a region specified by the user is used. Further, as the specified region, the whole portion of the image can be used or a region (which is hereinafter referred to as a processing region) to be subjected to the trimming/masking process may be used. A method for specifying the region by the user will be described later.

In the present embodiment, it is assumed that the background color detecting section 41 detects a concentration or color of pixels which configure the background as the background color. When the background is formed of a specified pattern, the background color detecting section 41 may be used to detect the pattern of the image used as the background.

For example, when a black-and-white image is processed, the background color detecting section 41 detects the concentration of pixels which configure the background as the background color based on the concentration of each pixel in the region. Further, when the background color of the black-and-white image is detected, the background color detecting section 41 forms a histogram for each concentration of each pixel in the specified region and detects the concentration which appears most frequently as the background color. In this case, the background color of the black-and-white image may be detected by deriving the average value of the concentration values of the respective pixels in the specified region as the background color.

When a color image is processed, the background color detecting section 41 detects a color which forms the background as the background color based on the color component of each pixel in the region. Further, when the background color of the color image is detected, the background color detecting section 41 forms a histogram for each color of each pixel in the region and detects the color which appears most frequently as the background color. In this case, the background color of the color image may be detected by deriving the average value of color data items of the respective pixels in the specified region as the background color.

The editing processing section 44 performs the editing process with respect to the image. The editing processing section 44 includes a trimming/masking processing section 45*a* and patch forming section 45*b*.

The trimming/masking processing section 45*a* performs a trimming process or masking process with respect to the processing region in the input image. The patch forming section 45*b* forms image data as a patch (patch image) which will be described later. The trimming/masking processing section 45*a* applies an image configured by pixels of fixed data to the processing region or applies a patch formed by the patch forming section 45*b* to the processing region.

Further, the second image processing section 40B includes a smoothing processing section 46. The smoothing processing section 46 smoothes a variation in the color in the boundary portion of the processing region according to a variation amount of the color between an image within the processing region and an image lying near and outside the processing region. The smoothing processing section 46 has a gradation processing section 46*a* which performs the gradation process. The gradation processing section 46*a* performs a process to make continuous a color variation in the boundary portion of the processing region on the image.

Next, the trimming/masking process by the image forming apparatus with the above configuration is explained.

Figure 2:
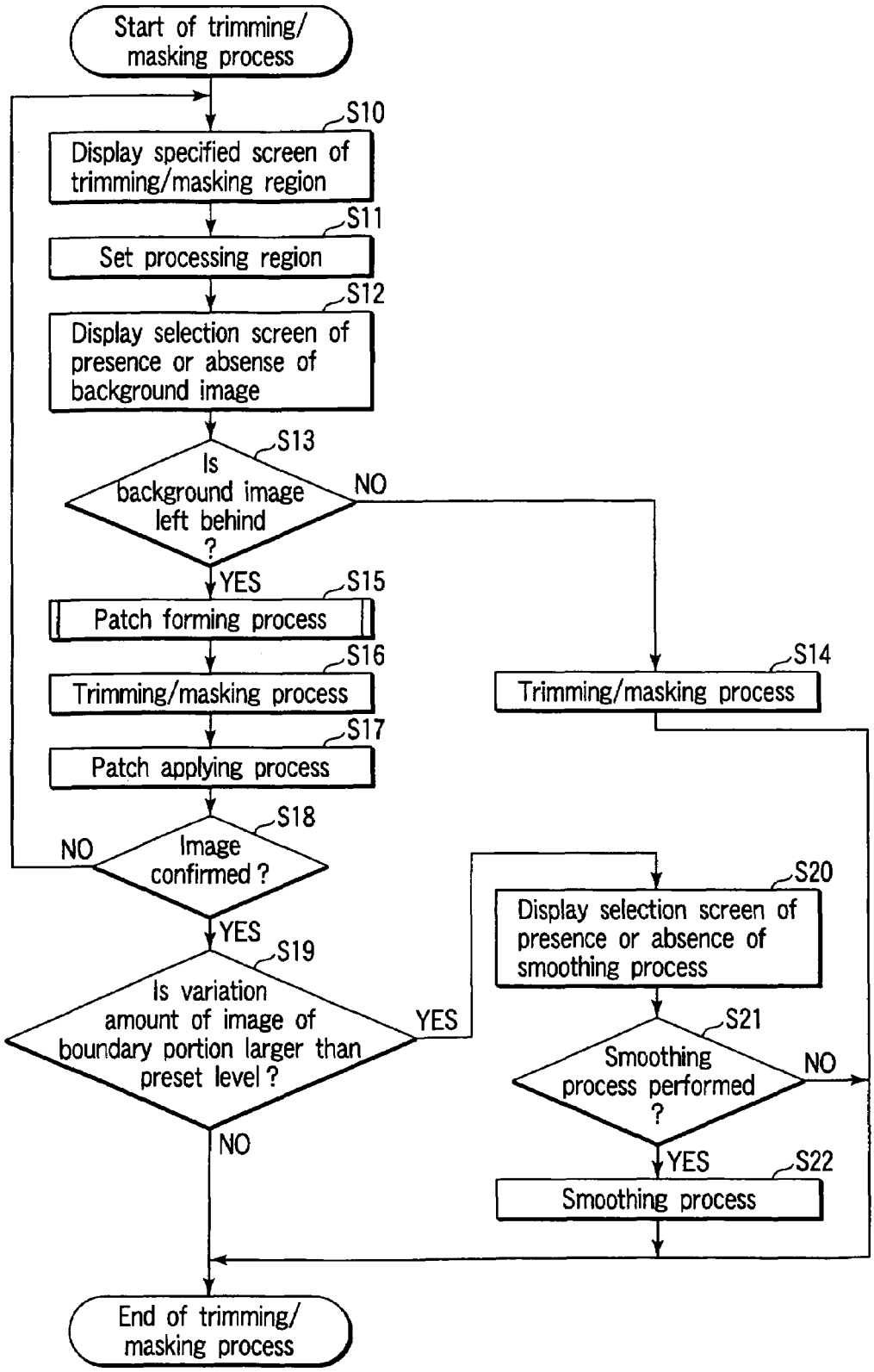
FIG. 2 is a flow chart for schematically illustrating a trimming/masking process.

FIG. 2 is a flowchart for illustrating the trimming/masking process.

First, the user selects one of the trimming process and masking process by use of the operating section 22 of the user interface 20. Then, the control section 10 causes the display section 21 of the user interface 20 to display a processing region specifying screen which permits the user to specify a region (which is hereinafter referred to as a processing region) to be subjected to the trimming/masking process (step S10).

Figure 3:
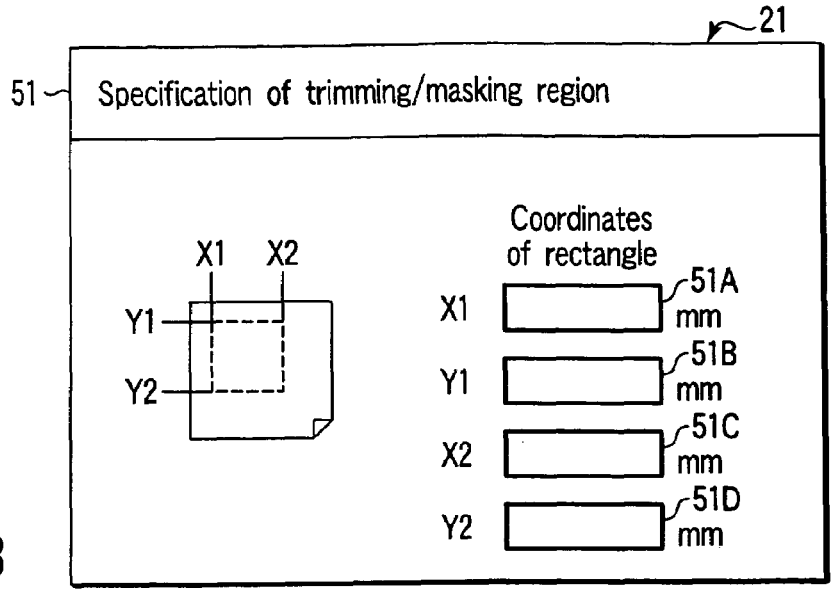
FIG. 3 shows an example of a specifying screen of a processing region.

As the processing region specifying screen, for example, a screen as shown in FIG. 3 is displayed. In an example of the processing region specifying screen shown in FIG. 3, the user specifies a processing region for the image by use of coordinate values. In the specifying screen shown in FIG. 3, the processing region is specified by use of a rectangle. In the specifying screen shown in FIG. 3, a rectangular region used as the processing region is specified by inputting four coordinate values for a rectangle into four input frames 51A, 51B, 51C, 51D.

The processing region may be specified by use of various shapes. For example, the processing region may be specified by use of a polygon, circle, eclipse or the like.

Further, the processing region can be specified by displaying an image on the touch panel used as the operating panel and permitting the user to touch the touch panel. In this case, it is necessary to fetch the image at least before the region is specified, but the user can directly and intuitively specify the processing region on the image.

In the image forming apparatus such as the copying machine, in general, an image read by the scanner as the image input section 30 is subjected to an image modifying process A and then the image is developed in the page memory 47. After this, the image developed in the page memory 47 is subjected to an image modifying process B and printed by use of a printer. That is, in the image processing section 40, the process for the input image is roughly divided into two processes, that is, a process before the image is developed in the page memory 47 and a process after the image is developed.

In the image forming apparatus such as the copying machine, there is a possibility that the position of a document with respect to the scanner will be changed if the image of the same document is read plural times with certain time intervals. Therefore, it is preferable that the scanner should read the image of the document immediately before the process as far as possible. This is because there occurs a possibility that the image read by the scanner before the specification of the processing region is deviated from the image read by the scanner after the specification of the processing region if the position of the document is changed before and after the specification of the processing region.

Therefore, it is effective to perform a process or the like which informs the user so as not to change the position of the document until input of an actually processed image (the document reading process) is completed in the image forming apparatus in a case wherein the image of a document is read by the scanner before the specification of the processing region. Thus, there is no positional deviation between an image displayed at the time of specification of the processing region and an image which is actually subjected to the trimming/masking process.

Further, it is possible to store the image of the document read by the scanner before the specification of the processing region to a memory device such as an HDD, develop the image stored in the memory device in the page memory and subject the image to the image modifying process such as the trimming/masking process. Also, in this case, there is no positional deviation between an image displayed at the time of specification of the processing region and an image which is actually subjected to the trimming/masking process.

The above operation is performed to suppress a possibility that the document position is changed after the processing region is specified.

If the user specifies the processing region, the control section 10 sets a processing region which is subjected to the trimming/masking process with respect to an input image (step S11). If the processing region is set, the control section 10 causes the display section 21 to display a selection screen which permits the user to determine whether or not one of a color and image pattern is attached to the processing region (step S12).

Figure 4:
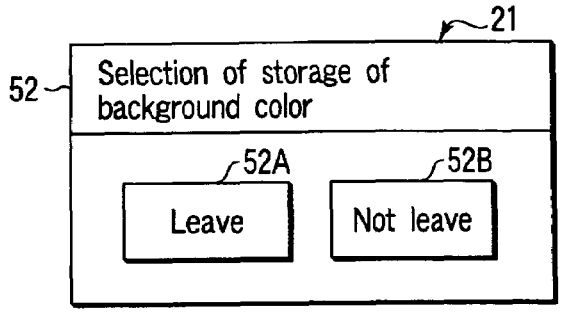
FIG. 4 shows a display example of a selection screen which displays the presence or absence of the background.

As the selection screen, a screen shown in FIG. 4 is displayed, for example. In the example of the selection screen shown in FIG. 4, a key 52A which specifies that a color or image pattern is attached to the processing region (the background color is left behind) and a key 52B which specifies that no color is left behind (white color is left) are displayed. The keys 52A and 52B are displayed by use of a touch panel used as the operating section 22. The user selects and specifies one of the keys 52A and 52B on the selection screen (step S13).

When the key 52B is specified by the user, that is, when it is selected that a color or image pattern is not attached to the processing region ("NO" in step S13), the control section 10 performs the trimming/masking process (step S14). Therefore, the processing region will be set to a preset image (an image formed of white or fixed data).

For example, when the key 52B is selected, the control section 10 performs the trimming/masking process by causing the trimming/masking processing section 45*a* to set image data in the processing region into white data (blank data). In this case, in an image obtained as the result of the trimming/masking process, all of pixels in the processing region in the image input from the image input section 30 are replaced by white pixels.

Further, when the key 52A is specified by the user, that is, when it is selected that a color or image pattern (which is hereinafter referred to as a background color) is attached to the processing region ("YES" in the step S13), the control section 10 starts the patch forming process (step S15) which will be described later. The patch forming process is a process to determine the background color in the processing region. A patch (patch image) formed by the patch forming process indicates the background color in the processing region. Therefore, as the result of the patch forming process, the background color of the processing region is formed as a patch.

After the patch is formed by the patch forming process, the control section 10 performs the trimming/masking process with respect to the processing region specified by the step S11 in the image input by the image input section 30 (step S16). The image subjected to-the trimming/masking process is developed in the page memory 47. When the image is developed in the page memory 47, the control section 10 overwrites the patch formed by the patch forming process with respect to the processing region in the image developed in the page memory 47 (step S17).

An image having the patch formed by the patch forming process and written into the processing region (the image subjected to the trimming/masking process) is completed by steps S11, S15 to S17. If the image having the patch formed by the patch forming process and written into the processing region is completed, the control section 10 displays the thus completed image on the display section 21 (step S18). By the above display operation, the user can confirm the image having the patch applied to the processing region.

Figure 5:
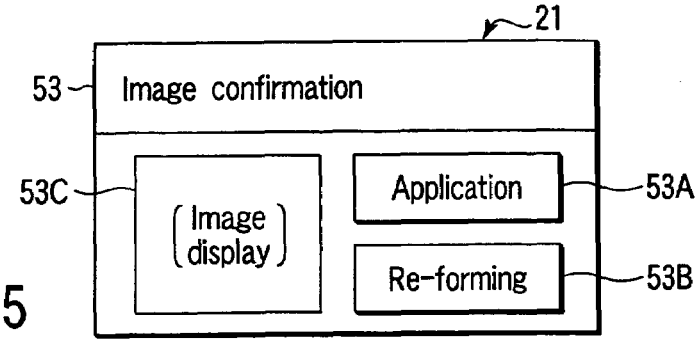
FIG. 5 shows a display example of a confirmation screen of an image.

As the image confirmation screen, for example, a screen shown in FIG. 5 is displayed. In an example of the image confirmation screen shown in FIG. 5, an application key 53A which specifies that the displayed image is satisfactory and a re-formation key (cancel key) 53B which specifies that the displayed image is canceled (the image is re-formed) are displayed together with a display frame 53C which displays the image subjected to the trimming/masking process. The application key 53A and re-formation key 53B are displayed by use of a touch panel used as the operating section 22.

Therefore, in the example of the image confirmation screen shown in FIG. 5, the user watches the image displayed in the display frame 53C and selects and specifies the application key 53A or re-formation key 53B. That is, the user watches the confirmation screen displayed on the display section 21 and determines whether the image is satisfactory or not.

In this case, if the image displayed on the display section 21 is not satisfactory, the user selects and specifies the re-formation key 53B in order to cancel the image. When the re-formation key 53B is specified ("NO" in step S18), the control section 10 returns the process to step S11 and repeats the above process.

If the image displayed on the display section 21 is satisfactory, the user selects and specifies application key 53A which indicates that the user has confirmed the image. When the application key 53A is specified ("YES" in step S18), the control section 10 determines whether a variation in the pixel level (for example, hue or saturation information) of each pixel in the boundary portion (several lines lying before and after the boundary) of the processing region is larger than a preset level or not (step S19).

When it is determined that a variation in the pixel level in the boundary portion of the processing region is not larger than the preset level ("NO" in step S19), the control section 10 completes the trimming/masking process without performing the smoothing process with respect to the processing region. Further, when it is determined that a variation in the pixel level in the boundary portion of the processing region is larger than the preset level ("YES" in step S19), the control section 10 causes the display section 21 to display the selection screen which permits the user to determine whether the smoothing process (gradation process) with respect to the processing region should be performed or not (step S20).

Figure 6:
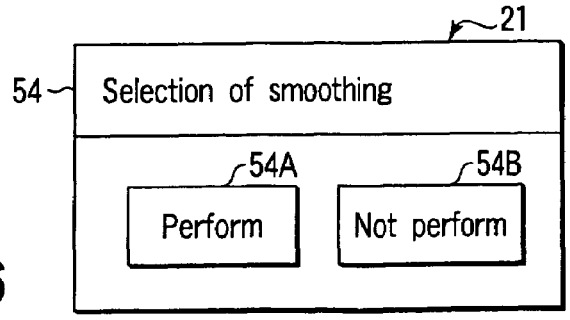
FIG. 6 shows a display example of a selection screen which indicates whether or not a smoothing process should be performed.

As the smoothing process selection screen, for example, a screen shown in FIG. 6 is displayed. On the smoothing process selection screen shown in FIG. 6, a key 54A which specifies that the smoothing process is performed with respect to the processing region and a key 54B which specifies that the smoothing process is not performed with respect to the processing region are displayed. The keys 54A and 54B are displayed by use of a touch panel used as the operating section 22. In the example of the selection screen shown in FIG. 6, the user selects and specifies the key 54A or 54B to determine whether or not the smoothing process is performed with respect to the processing region.

In the above example, only when it is detected in step S19 that a variation in the pixel level in the boundary portion of the processing region is larger than the preset level, the smoothing process selection screen is displayed so as to permit the user to selectively determine that the smoothing process is performed or not. However, the process of step S19 can be omitted. That is, it is possible to display the smoothing process selection screen so as to permit the user to selectively determine that the smoothing process is performed or not irrespective of the variation amount in the pixel level in the boundary portion of the processing region.

When the key 54B is specified, that is, when the user specifies that the smoothing process is not performed ("NO" in step S21), the control section 10 completes the trimming/masking process without performing the smoothing process.

Further, when the key 54A is specified, that is, when the user specifies that the smoothing process is performed ("YES" in step S21), the control section 10 starts to perform the smoothing process (step S22).

The smoothing process is a process which makes continuous a variation in the colors of the respective pixels in the boundary portion of the processing region. That is, in the smoothing process, the colors are continuously changed between the color in the processing region and the color outside the processing region. Therefore, according to the smoothing process, the colors of the respective pixels in the boundary portion of the processing region are changed so as to make a smooth variation in the color based on the color in the processing region and the color in a portion near and outside the processing region.

After the smoothing process is terminated, the control section 10 completes the trimming/masking process. It is also possible for the user to confirm an image subjected to the smoothing process when the smoothing process is terminated. For example, the control section 10 causes the same screen as the confirmation screen shown in FIG. 5 to be displayed on the display section 21 and permits the user to confirm an image subjected to the smoothing process.

Next, the patch forming process is explained in detail.

Figure 7:
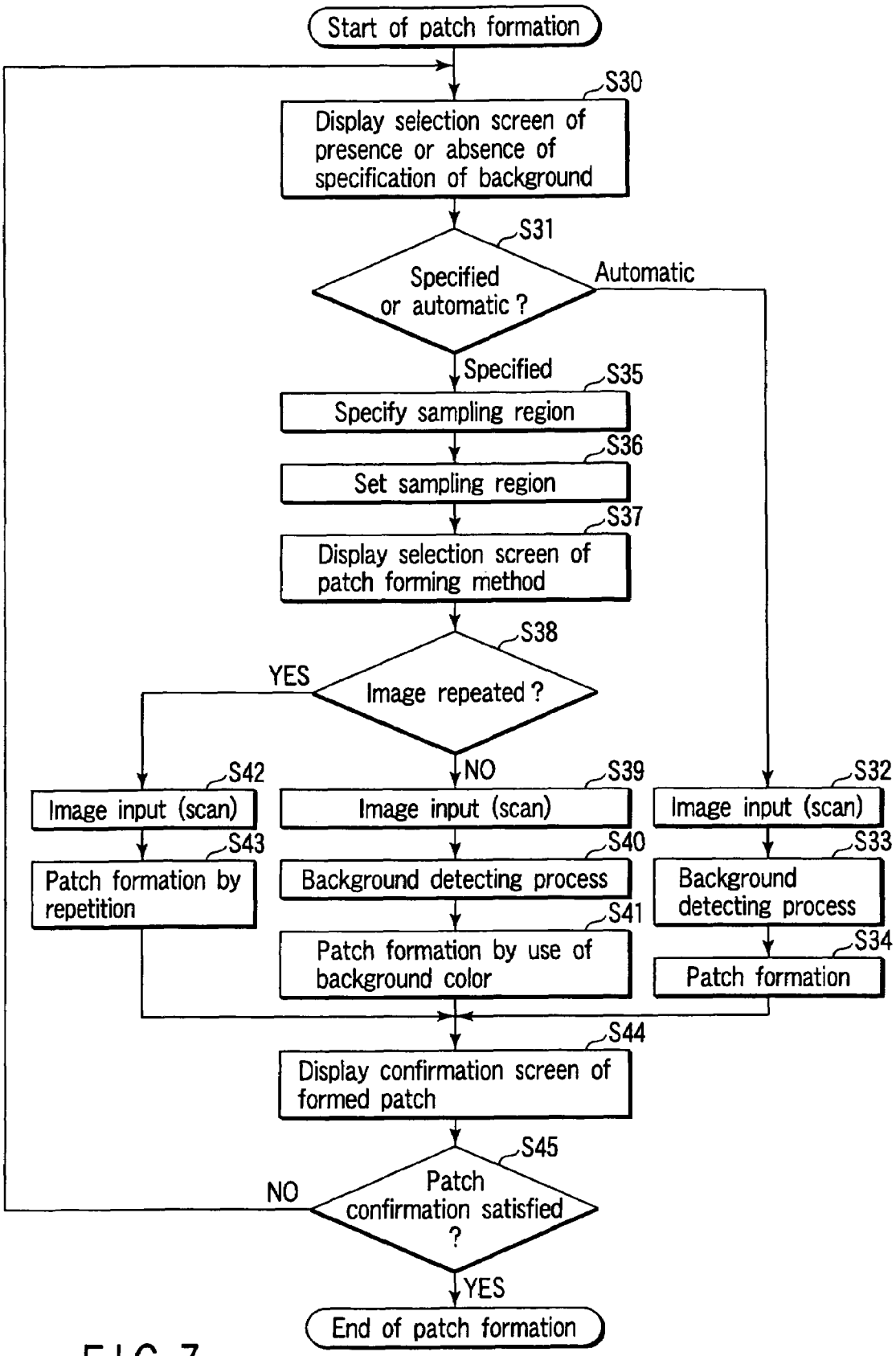
FIG. 7 is a flowchart for illustrating a patch forming process.

FIG. 7 is a flowchart for illustrating the patch forming process in step S15 in FIG. 2.

First, a process which automatically forms a patch (auto mode, steps S30 to S34) is explained.

As shown in FIG. 7, when a trimming/masking region (processing region) is specified and the user is instructed to attach a background color to the processing region, the control section 10 displays a patch specifying screen which specifies a background color as a patch of the processing region (step S30).

Figure 8:
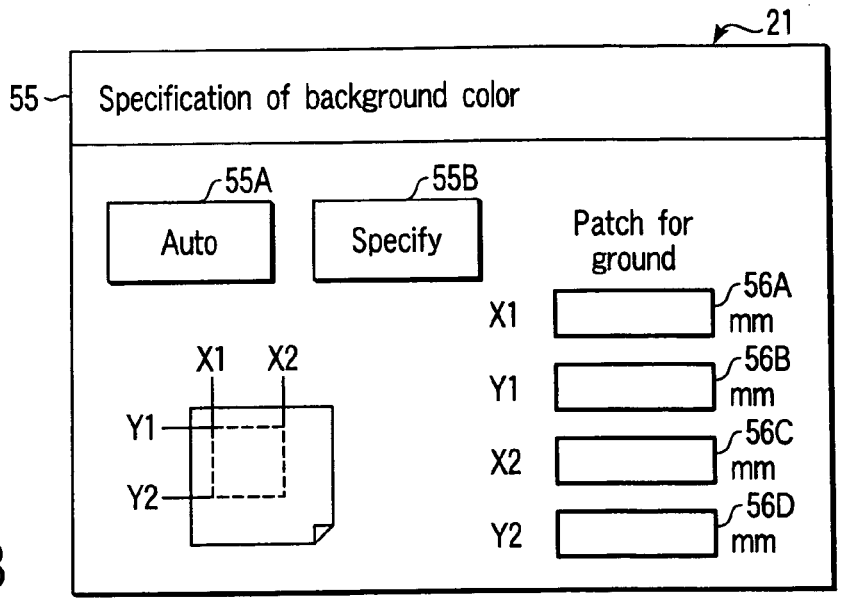
FIG. 8 shows a display example of a specifying screen which displays the background color.

As the patch specifying screen, for example, a screen as shown in FIG. 8 is displayed. In an example of the patch specifying screen shown in FIG. 8, an automatic key 55A used to specify that the background color attached to the processing region is automatically set (auto mode) and a specifying key 55B used to specify that the user specifies the background color attached to the processing region (manual mode) are displayed. The automatic key 55A and specifying key 55B are displayed by use of a touch panel used as the operating section 22. The user selects and specifies the automatic key 55A or specifying key 55B on the selection screen (step S31).

When the user specifies the automatic key 55A on the patch specifying screen ("auto" in step S32), the control section 10 performs the process (the patch forming process in the auto mode) in which the background color (patch) of the processing region is automatically set (steps S32 to S34).

In the patch forming process in the auto mode, first, the control section 10 inputs an image by use of the image input section 30 (step S32). For example, if a scanner is used as the image input section 30, the control section 10 operates the scanner to read an image of a document.

When an original image is input by use of the image input section 30, the control section 10 performs a background color detecting process to detect the background color by use of the background color detecting section 41 (step S33). The background color detecting process is a process in which a color is detected and used to form a patch.

For example, in the background color detecting process, the background color within the processing region in the image (original image) input by use of the image input section 30 is detected. Further, in the background color detecting process, it is possible to detect the background color of the whole portion of the image input by use of the image input section 30. Further, in the background color detecting process, a color which appears most frequently in the image of the processing region or in the whole input image is detected as the background color. In the background color detecting process, it is also possible to detect average data of the pixels in the image of the processing region or in the whole input image as the background color.

When the background color is detected in the background color detecting process, the control section 10 forms a patch configured by pixels of the background color detected by the background color detecting section 41 (step S34).

Generally, when it is desired to erase only an image such as characters in the processing region or when the background color of the whole portion of the original image is not uniform, it is preferable to form a patch by use of the background color in the processing region. When the patch is formed by use of the background color in the processing region, the processing region is replaced by a color detected as the background color in the processing region.

For example, when the patch is formed by use of the background color in the processing region, it becomes possible to cancel or erase only an image such as characters in the processing region with the background color in the processing region left behind. Further, when the background color is detected only in the processing region and if the background color of the whole portion of the image is not uniform, a sampling region used to detect the background color is limited within the processing region. Therefore, a merit that the most natural background color with respect to the processing region can be easily detected can be attained.

On the other hand, when it is desired to prevent the color of the processing region from producing unnatural feelings in the whole image or when the background color of the whole portion of the image is uniform, it is preferable to form a patch by use of the background color of the whole portion of the image. When the patch is formed by use of the background color of the whole portion of the image, the processing region is replaced by a color detected as the background color of the whole portion of the image.

For example, when the patch is formed by use of the background color of the whole portion of the image, the color of the processing region matches with the whole portion of the image so that the color of the processing region can be prevented from producing unnatural feelings in the whole image. Further, when the background color is detected based on the whole image and if the background color of the image is uniform, a sampling region used to detect the background color becomes large. Therefore, a merit that a natural background color can be easily detected can be attained.

As described above, in the automatic patch forming process, the method of detecting the background color and a region in which the background color is detected can be adequately determined according to the application condition of the image forming apparatus.

Next, a process (manual mode [steps S30, S31, steps S35 to S43]) performed when the user specifies the background color attached to the processing region is explained.

When the trimming/masking region (processing region) is specified and the user specifies that the background color is attached to the processing region, the control section lo displays a patch specifying screen which specifies the background color as a patch of the processing region (step S30).

When the user specifies the specifying key 55B on the patch specifying screen ("specified" in step S31), the control section 10 performs a process (a patch forming process in the manual mode) in which the background color (patch) of the processing region is set based on a region specified by the user (steps S35 to S43).

That is, when the specifying key 55B is specified on the patch specifying screen, the user specifies a sampling region used to form a patch by use of the operating section 22 (step S35). For example, the sampling region is specified by the user on a screen as shown in FIG. 8. In the example shown in FIG. 8, the sampling region is specified by inputting four coordinate values of a rectangle. The sampling region can be specified by the same operation as that performed to specify the trimming/masking processing region.

When the sampling region is specified by the user, the control section 10 holds the coordinate values indicating the specified sampling region (step S36). When thus holding the sampling region, the control section 10 displays a selection screen used to select a patch forming method (step S37). As the patch forming method, it is assumed that a method (first method) for forming a patch based on the background color detected in the sampling region and a method (second method) for forming a patch with a size applicable to the processing region by repeatedly providing an image of the sampling region can be selected.

Figure 9:
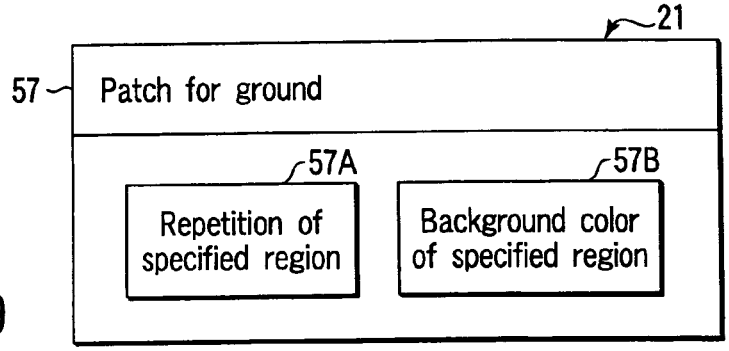
FIG. 9 shows a display example of a selection screen of a patch forming method.

For example, as the selection screen of the patch forming method, a screen as shown in FIG. 9 is displayed. In the example of the selection screen of FIG. 9, a key 57A used to select the method for forming a patch according to the first method and a key 57B used to select the method for forming a patch according to the second method are displayed. The keys 57A and 57B are displayed by use of a touch panel used as the operating section 22.

When the key 57A is specified by the user, that is, when the first method for forming a patch based on the background color detected in the sampling region is selected ("NO" in step S38), the control section 10 causes the background color detecting section 41 to start a process for detecting the background color in the sampling region.

Then, the control section 10 first causes the image input section 30 to input an image (step S39). For example, when a document image is read by use of the scanner used as the image input section 30, the control section 10 reads an image of the document.

When an image is input by the image input section 30, the control section 10 causes the background color detecting section 41 to perform a background color detecting process to detect the background color (step S40). The background color detecting process is a process for detecting a color used to form a patch. For example, in the background color detecting process, a color which appears most frequently in the sampling region is detected as the background color. Further, in the background color detecting process, average data of the pixels in the sampling region may be detected as the background color.

When the background color in the sampling region is detected in the background color detecting process, the control section 10 forms a patch configured by pixels of the background color detected by the background color detecting section 41 (step S41).

Further, when the key 57B is specified by the user, that is, when the second method for forming a patch by repeatedly providing an image of the sampling region is selected ("YES" in step S38), the control section 10 starts a process for forming a patch by repeatedly providing the image of the sampling region.

Then, the control section 10 first causes the image input section 30 to input an image (step S42). For example, when a document image is read by use of the scanner used as the image input section 30, the control section 10 reads an image of the document.

When an image is input by the image input section 30, the control section 10 forms a patch with the same size as the processing region by repeatedly providing an image of the sampling region (step S43).

When the patch is formed in steps S35, S41 or S43, the control section 10 causes the display section 21 to display a confirmation screen which permits the user to confirm the formed patch (step S44).

Figure 10:
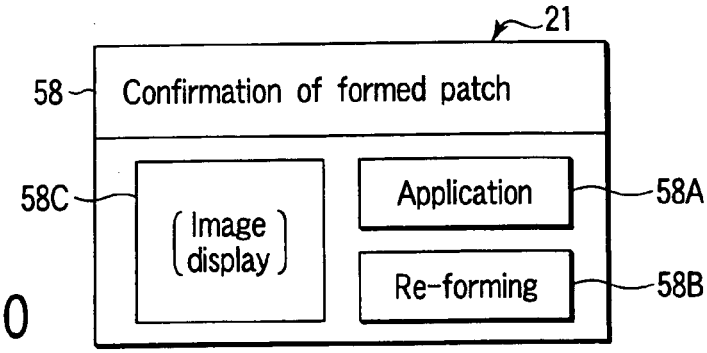
FIG. 10 shows a display example of a confirmation screen which displays a formed patch.

As the patch confirmation screen, for example, a screen shown in FIG. 10 is displayed. In an example of the patch confirmation screen of FIG. 10, an application key 58A which specifies application of the displayed patch and a re-forming key (cancel key) 58B which specifies cancellation (patch re-formation) of the displayed patch are displayed together with a display frame 58 used to display the formed patch. The application key 58A and re-forming key 58B are displayed by use of a touch panel used as the operating section 22.

That is, in an example of the image confirmation screen of FIG. 10, the user watches the patch displayed in the display frame 58 and selects and specifies the application key 58A or re-forming key 58B.

In this case, if the user is satisfied with the patch displayed in the display frame 58, the user selects and specifies the application key 58A which permits application of the formed patch. When the application key 58A is specified ("YES" in step S45), the control section 10 completes the patch forming process. After the patch forming process is completed, the control section 10 proceeds the process to step S16 of FIG. 2 so as to perform the trimming/masking process using the formed patch.

Further, if the user is not satisfied with the patch displayed in the display frame 58, the user selects and specifies the re-forming key 58B to re-form or cancel the patch. When the re-forming key 58B is specified ("NO" in step S45), the control section 10 returns the process to step S31 to repeat the above process.

The sampling region may be specified by displaying an original image on the touch panel used as the operating section 22 and causing the user to touch the touch panel while watching the original image. In this case, it is required to fetch the image at least before the sampling region is specified, but a merit that the user can directly and intuitively specify the sampling region on the original image can be attained.

As described above, when an image of the same document is read plural times at time intervals in the image forming apparatus such as a copying machine, there is a possibility that the position of the document in the scanner is changed. Therefore, it is preferable for the scanner to read the image immediately before the image processing process as far as possible.

That is, if the position of the document in the scanner is changed before and after the sampling region is specified, there occurs a possibility that the image read by the scanner after the sampling region is specified will be deviated from the image read by the scanner before the sampling region is specified.

Therefore, in a case where the image of the document in the scanner is read before the sampling region is specified, it is effective to perform the process for, for example, suggesting the user so as not to change the position of the document until input of the image to be actually processed (document reading process) is completed in the image forming apparatus. As a result, there occurs no positional deviation between an image displayed at the time of specification of the sampling region and an image to be actually subjected to the trimming/labeling process.

Further, an image read by the scanner before specification of the sampling region may be stored in a memory device such as an HDD and a patch may be formed based on the image stored in the memory device. In this case, an original image for the trimming/labeling process is fetched from the image stored in the memory device and is subjected to the image modifying process. As a result, there occurs no positional deviation between an image displayed at the time of specification of the sampling region and an image to be actually subjected to the trimming/labeling process.

Next, an application example of the trimming/masking process is explained.

Figure 11:
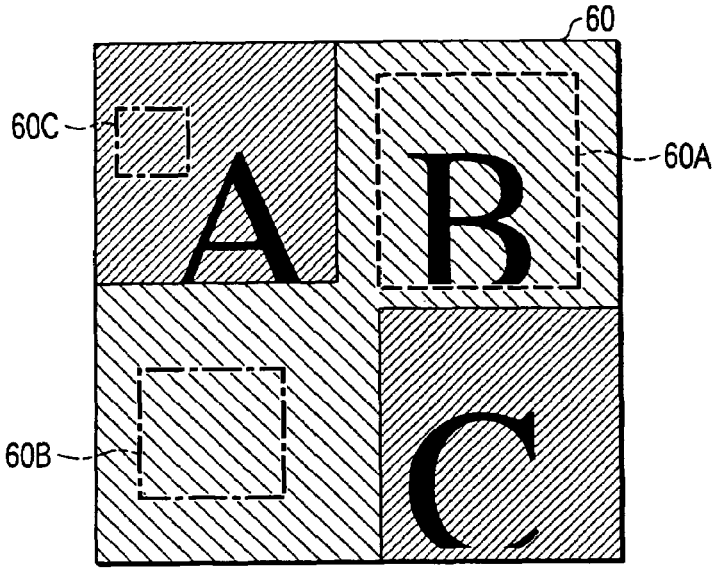
FIG. 11 is a diagram showing an example of an input image.
Figure 12:
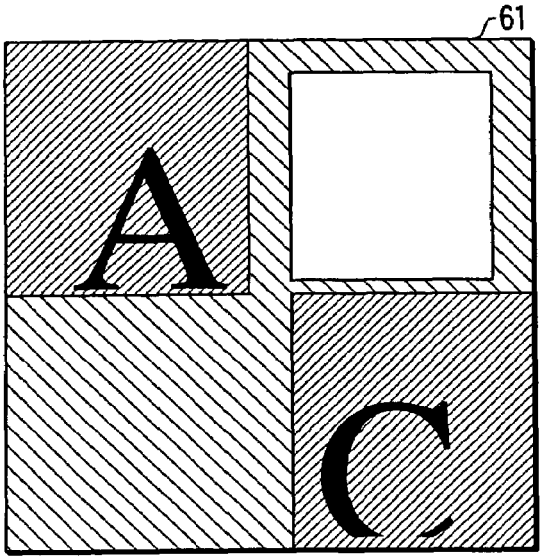
FIG. 12 is a diagram showing an example of an image subjected to the masking process without using the background color for the image of FIG. 11.
Figure 13:
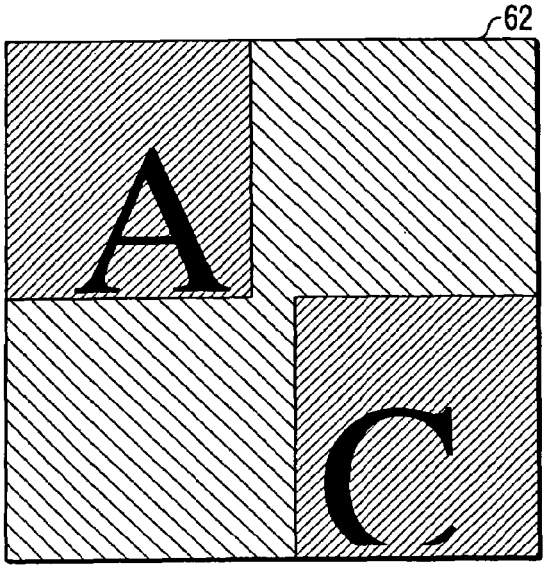
FIG. 13 is a diagram showing an example of an image obtained by applying a patch formed in the auto mode or manual mode to the image of FIG. 11.
Figure 14:
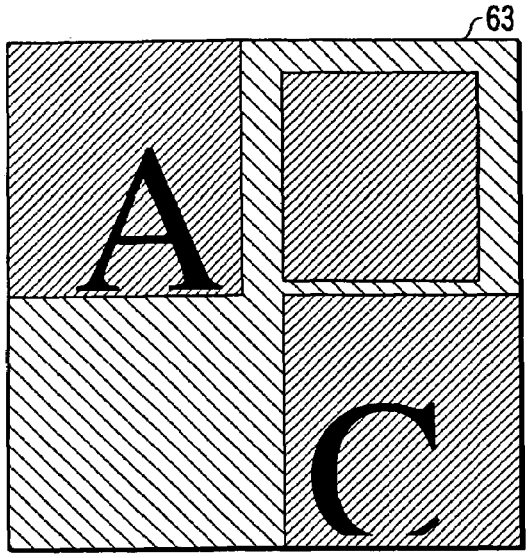
FIG. 14 is a diagram showing an example of an image obtained by applying a patch formed in the manual mode to the image of FIG. 11.

FIG. 11 shows an example of an image (original image) 60 input by the image input section 30. FIGS. 12, 13, 14 show examples of images 61, 62, 63 obtained by subjecting the image 60 shown in FIG. 11 to the masking process.

In FIG. 11, a region 60A is a processing region which is subjected to the masking process, a region 60B is a sampling region which is specified by the user, and a region 60C is a sampling region which is specified by the user.

First, in the masking process for the image 60, when the user specifies the key 52B ("the background color is not left behind") on the selection screen 52 for selection of the presence or absence of the background color, the processing region 60A of the image 60 is replaced by white data as fixed data as shown in FIG. 12.

That is, when "the background color is not left behind" is specified as the process condition of the masking process, the processing region 60A is replaced by white color and the image 60 is converted into the image 61 as shown in FIG. 12.

Further, in the masking process for the image 60, when the user specifies the key 52A ("the background color is left behind") on the selection screen 52 for selection of the presence or absence of the background color and specifies the automatic key 55A on the specifying screen of the background color, the processing region 60A of the image 60 is replaced by a background color detected by the background color detecting section 41.

That is, when "the background color is left behind" and "the background color is 'automatically' detected" are specified as the process condition of the masking process (auto mode), the processing region 60A is replaced by the background color of a preset region (in the whole image or processing region) and the image 60 is converted into the image 62 as shown in FIG. 13.

Further, in the masking process for the image 60, when the user specifies the key 52A ("the background color is left behind") on the selection screen 52 for selection of the presence or absence of the background color, specifies the sampling region 60B and the specifying key 55B on the background color specifying screen 55 and specifies "the background color of the specified region" on the selection screen for the patch forming method, the processing region 60A of the image 60 is replaced by a background color detected as the background color of the sampling region 60B by the background color detecting section 41 as shown in FIG. 13.

That is, when it is specified to detect the background color of the processing region 60A from the sampling region 60B as the process condition of the masking process (manual mode), the processing region 60A is replaced by the background color in the sampling region 60B and the image 60 is converted into the image 62 as shown in FIG. 13.

Further, in the masking process for the image 60, when the user specifies the key 52A ("the background color is left behind") on the selection screen 52 for selection of the presence or absence of the background color, specifies the sampling region 60C and the specifying key 55B on the specifying screen 55 of the background color and specifies "the background color of the specified region" on the selection screen for the patch forming method, the processing region 60A of the image 60 is replaced by a background color detected as the background color of the sampling region 60C by the background color detecting section 41 as shown in FIG. 14.

That is, when it is specified to detect the background color of the processing region 60A from the sampling region 60C as the process condition of the masking process (manual mode), the processing region 60A is replaced by the background color in the sampling region 60C and the image 60 is converted into the image 63 as shown in FIG. 14.

Next, an example of an image in which the patch formed by repeatedly providing the image of the sampling region specified by the user is applied to the processing region is explained.

Figure 15:
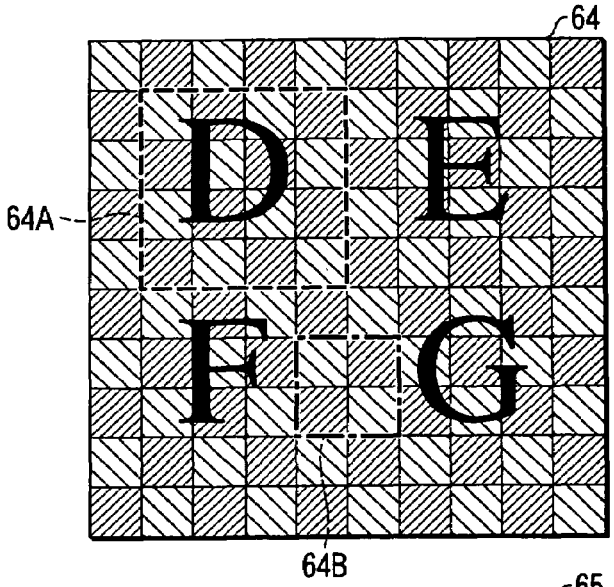
FIG. 15 is a diagram showing an example of an input image.
Figure 16:
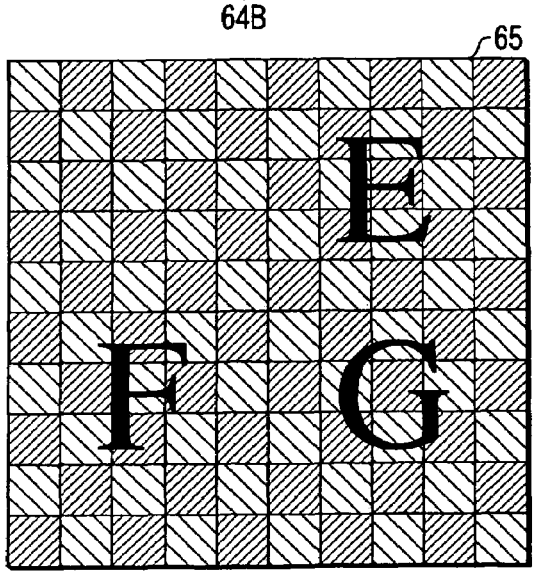
FIG. 16 is a diagram showing an example of an image obtained by applying a patch formed by repeatedly providing an image of a sampling region to the image of FIG. 15.

FIG. 15 shows an example of an image (original image) 64 input by the image input section 30. FIG. 16 is a diagram showing an example of an image 65 obtained by subjecting the image 64 to the masking process.

In FIG. 15, it is assumed that a region 64A is a processing region to be subjected to the masking process and a region 64B is a sampling region specified by the user.

In the masking process for the image 64, when the user specifies the key 52A ("the background color is left behind") on the selection screen 52 for selection of the presence or absence of the background color, specifies the sampling region 60B and the specifying key 55B on the background color specifying screen 55 and specifies "repetition of the specified region" on the selection screen for the patch forming method, the processing region 64A of the image 64 is replaced by an image obtained by repeatedly providing the image of the sampling region 64B as shown in FIG. 16.

That is, when "the background color is left behind" and the image which is obtained by repeatedly providing the image of the sampling region specified by the user and used as the background color are specified (manual mode), the processing region 64A is replaced by the image obtained by repeatedly providing the image of the sampling region and the image 64 is converted into the image 65 as shown in FIG. 16.

As described above, in the present embodiment, a patch image which is applied to a processing region subjected to the trimming/masking process is formed based on the background image or the like of an original image and the image of the processing region in the original image is replaced by the patch image. As a result, a pattern of a color or image which the user wants to obtain can be applied to the processing region in the trimming/masking process.

For example, when it is desired to erase only image information such as characters in the processing region and leave behind a natural background color in the processing region without performing any particular operation, the user specifies "auto". As a result, it becomes possible to erase only image information such as characters in the processing region and leave behind the natural background color without performing the operation of specifying an image applied to the processing region. Particularly, when the background of the processing region or the whole portion of the input image is uniform, the background color can be easily and automatically detected. Therefore, only if the user specifies "auto", an image formed of a natural background color can be applied to the processing region.

Further, when it is desired to apply a color which the user wants to obtain to the processing region, the user specifies a sampling region having a background of the color which is desired to be applied to the processing region. Thus, the image of the background color of the sampling region which the user has specified can be applied to the processing region. Particularly, if the background of the whole image is not uniform as in the image 60 shown in FIG. 11, the background color which the user wants to obtain can be applied to the processing region without fail by permitting the user to specify the sampling region.

Further, when it is desired to apply an image pattern which the user wants to use to the processing region, the user specifies a sampling region formed of the image pattern which is desired to be applied to the processing region. Thus, an image formed of the image of the sampling region which the user has specified can be applied to the processing region. Particularly, if the background of the image is not uniform as in the image 64 shown in FIG. 15, the image formed of the image pattern which the user wants to use can be applied to the processing region without fail by permitting the user to specify the sampling region.

That is, according to the present embodiment, an image pattern or color other than the preset color can be applied to the processing region which is subjected to the trimming/masking process according to the intention of the user.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image processing apparatus which performs an image modifying process with respect to an original image input via an image input section, comprising:

a processing region setting section which sets a processing region in the original image input via the image input section;

a sampling region specifying section which specifies a sampling region for forming a patch image applied to the processing region in the original image input via the image input section;

a sampling region setting section which sets the sampling region specified by the sampling region specifying section;

a background image detecting section which detects a background image in the sampling region specified by the sampling region setting section;

an image forming section which forms the patch image to be applied to the processing region specified by the processing region setting section, based on the background image in the sampling region detected by the background image detecting section; and an image editing section which replaces the image of the processing region in the original image input via the image input section by the patch image formed by the image forming section.

2. The image processing apparatus according to claim 1, further comprising:

a smoothing processing section which performs a smoothing process for smoothing the variation in the image in a boundary portion of the processing region in the image to which the patch image formed by the image forming section is applied.

3. The image processing apparatus according to claim 2, further comprising:

a determining section for determining whether or not the variation amount in the boundary portion of the processing region exceeds a predetermined amount in the image to which the patch image formed by the image forming section is applied, wherein the smoothing processing section performs a smoothing process in the boundary portion of the processing region to which the patch image is applied, when the variation amount in the boundary portion of the processing region is determined to exceed the predetermined amount by the determining section.

4. The image processing apparatus according to claim 2, further comprising:

a selecting section which determines whether or not the smoothing process is performed by the smoothing processing section, wherein the smoothing processing section performs the smoothing process in the boundary portion of the processing region in the image to which the patch image is applied, when the smoothing process is determined to be performed by the smoothing selecting section.

5. The image forming apparatus according to claim 1, further comprising:

a smoothing processing section which performs a smoothing process for smoothing the variation of the image in the boundary portion of the processing region to which the patch image formed by the image forming section is applied, wherein the image forming section forms the patch image having the same size as the processing region by repeatedly providing the image of the sampling region in the original image input via the image input section.

6. The image forming apparatus according to claim 5, further comprising:

a determining section which determines whether or not a variation amount in the boundary portion of the processing region exceeds a predetermined amount in the image to which the patch image formed by the image forming section is applied, wherein the smoothing processing section performs a smoothing process in the boundary portion of the processing region in the image to which the patch image is applied, when the variation amount in the boundary portion of the processing region is determined to exceed a predetermined amount by the determining section.

7. The image processing apparatus according to claim 5, further comprising:

a selecting section which determines whether or not the smoothing process is performed by the smoothing processing section, wherein the smoothing processing section performs the smoothing process in the boundary portion of the processing region in the image to which the patch image is applied, when the smoothing process is determined to be performed by the smoothing selecting section.

8. An image processing method which performs an image modifying process with respect to an original image input via an image input section, comprising:

setting a processing region in the original image input via the image input section;

specifying a sampling region which sets a sampling region for forming a patch image to be applied to the processing region in the original image input via the image input section;

setting the sampling region specified by a sampling region setting section;

detecting a background image in the sampling region;

forming the patch image to be applied to a processing region specified by a processing region specifying section based on the image of the sampling region specified by a sampling region specifying section; and replacing the image of the processing region in the original image input via the image input section with the patch image formed based on the image of the sampling region, wherein the patch image is formed based on the background image detected from the sampling region.

9. The image processing method according to claim 8, further comprising:

performing a smoothing process for smoothing the variation in the image in the boundary portion of the processing region to which the patch image is applied.

10. The image processing method according to claim 9, further comprising:

determining whether or not the variation amount in the boundary portion of the processing region exceeds a predetermined amount in the image to which the patch image is applied, wherein the smoothing process is performed in the boundary portion of the processing region to which the patch image is applied, when the variation amount in the boundary portion of the processing region is determined to exceed the predetermined amount by a determining section.

11. The image processing method according to claim 9, further comprising:

determining whether or not the smoothing process is performed by an operation key, wherein the smoothing process is performed in the boundary portion of the processing region in the image to which the patch image is applied, when the smoothing process is determined to be performed by the operation key.

12. The image forming method according to claim 8, further comprising:

performing the smoothing process for smoothing the variation of the image in the boundary portion of the processing region to which the patch image is applied, wherein the patch image forms the image having the same size as the processing region by repeatedly providing the image of the sampling region in the original image input via the image input section.

13. The image forming method according to claim 12, further comprising:

determining whether or not the variation amount in the boundary portion of the processing region exceeds a predetermined amount in the image to which the patch image is applied, wherein the smoothing process is performed in the boundary portion of the processing region in the image to which the patch image is applied, when the variation amount in the boundary portion of the processing region is determined to exceed a predetermined amount.

14. The image processing method according to claim 12, further comprising:

a determining whether or not the smoothing process is performed by an operation key, wherein the smoothing process is performed in the boundary portion of the processing region in the image to which the patch image is applied, when the smoothing process is determined to be performed by the operation key.

* * * * *